US010368160B2

(12) United States Patent
Qin et al.

(10) Patent No.: US 10,368,160 B2
(45) Date of Patent: Jul. 30, 2019

(54) SPEAKER BOX

(71) Applicant: AAC Technologies Pte. Ltd., Singapore (SG)

(72) Inventors: Peng Qin, Shenzhen (CN); Wei Wei, Shenzhen (CN); Zhichen Chen, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 16/056,653

(22) Filed: Aug. 7, 2018

(65) Prior Publication Data

US 2019/0132669 A1 May 2, 2019

(30) Foreign Application Priority Data

Nov. 2, 2017 (CN) ..... 2017 2 1448857 U

(51) Int. Cl.
*H04R 1/28* (2006.01)
*H04R 1/02* (2006.01)
*H04R 7/12* (2006.01)

(52) U.S. Cl.
CPC ..... *H04R 1/288* (2013.01); *H04R 1/023* (2013.01); *H04R 1/025* (2013.01); *H04R 7/127* (2013.01); *H04R 2499/11* (2013.01)

(58) Field of Classification Search
CPC ..... H04R 1/288; H04R 1/023; H04R 1/025; H04R 7/127; H04R 2499/11
USPC ..... 381/334, 351
See application file for complete search history.

(56) References Cited

U.S. PATENT DOCUMENTS 8,794,373 B1 * 8/2014 Lin ..... B01D 53/0407 181/151
9,137,593 B2 * 9/2015 Klein ..... H04R 1/02
9,749,735 B1 * 8/2017 Silver ..... H04R 1/2811
2011/0308883 A1 * 12/2011 Eaton ..... F24F 7/065 181/224
2014/0064540 A1 * 3/2014 Lin ..... H04R 1/2803 381/346
2016/0119718 A1 * 4/2016 Yang ..... H04R 9/02 381/351
2016/0345084 A1 * 11/2016 Friza ..... H04R 1/023
2016/0345090 A1 * 11/2016 Wilk ..... B01D 53/04
2017/0178615 A1 * 6/2017 Lin ..... G10K 11/168
2017/0195781 A1 * 7/2017 Kang ..... B01J 20/18
2017/0265008 A1 * 9/2017 Ge ..... H04R 9/06
2018/0115820 A1 * 4/2018 Qin ..... H04R 1/025
2018/0167738 A1 * 6/2018 Liu ..... H04R 9/06
2018/0255393 A1 * 9/2018 Wang ..... H04R 1/2819

* cited by examiner

*Primary Examiner* — Paul Kim
*Assistant Examiner* — Friedrich Fahnert
(74) *Attorney, Agent, or Firm* — Na Xu; IPro, PLLC

(57) ABSTRACT

The present application discloses a speaker box. The speaker box includes a lower cover; an upper cover engaging with the lower cover for forming an accommodating space; a speaker accommodated in the accommodating space, and including a diaphragm with a dome attached to the diaphragm; a front sound cavity formed by the diaphragm and the upper cover; and air adsorbent particles received in the front sound cavity. The dome forms at least one recess communicating with the front sound cavity, and the air adsorbent particles are received in the recesses.

7 Claims, 4 Drawing Sheets

SPEAKER BOX

FIELD OF THE PRESENT DISCLOSURE

This disclosure related to the field of electro-acoustic transducers, and more particularly to a speaker box used in a portable electronic device, like a mobile phone.

DESCRIPTION OF RELATED ART

A mobile phone is more and more popular in day life. As one important feature of a mobile phone, music play-back is one of the concerns for a user to choose a phone. A speaker box is a component, or a transducer to convert electrical signals to audible sounds (music).

A related speaker box used in a mobile phone includes a housing and a speaker received in the housing. Generally, the speaker includes a diaphragm for radiating sounds, and a front sound cavity formed between the diaphragm and the housing. For transmitting sounds outside, the speaker box further includes a sound passageway communicating the front cavity and the outside. The front sound cavity and the sound passageway cooperatively form a front cavity. However the inner sides of the sound cavity are smooth and provide little damping. Further, the front cavity will produce resonance during the vibration of the diaphragm, which will further produce distortion peaks. Distortion peaks will cause high-frequency noises and distortion of sounds. Acoustic performance is accordingly lowered.

Therefore it is necessary to provide an improved speaker box for overcoming the above-mentioned disadvantages.

BRIEF DESCRIPTION OF THE DRAWINGS

Many aspects of the exemplary embodiment can be better understood with reference to the following drawing. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to an exemplary embodiment. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

Figure 1:
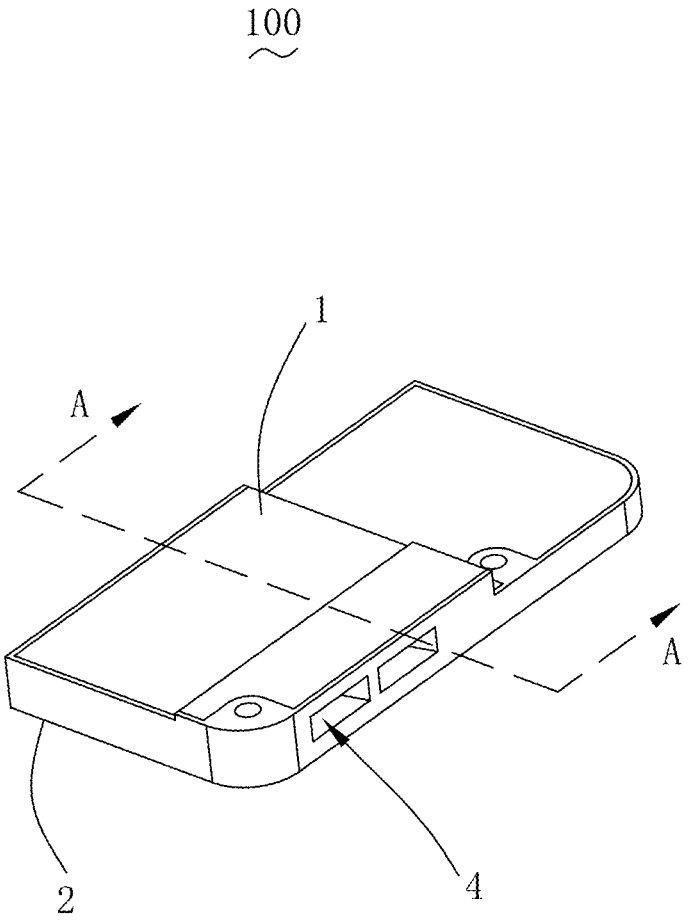
FIG. 1 is an isometric view of a speaker box in accordance with an exemplary embodiment of the present invention.
Figure 2:
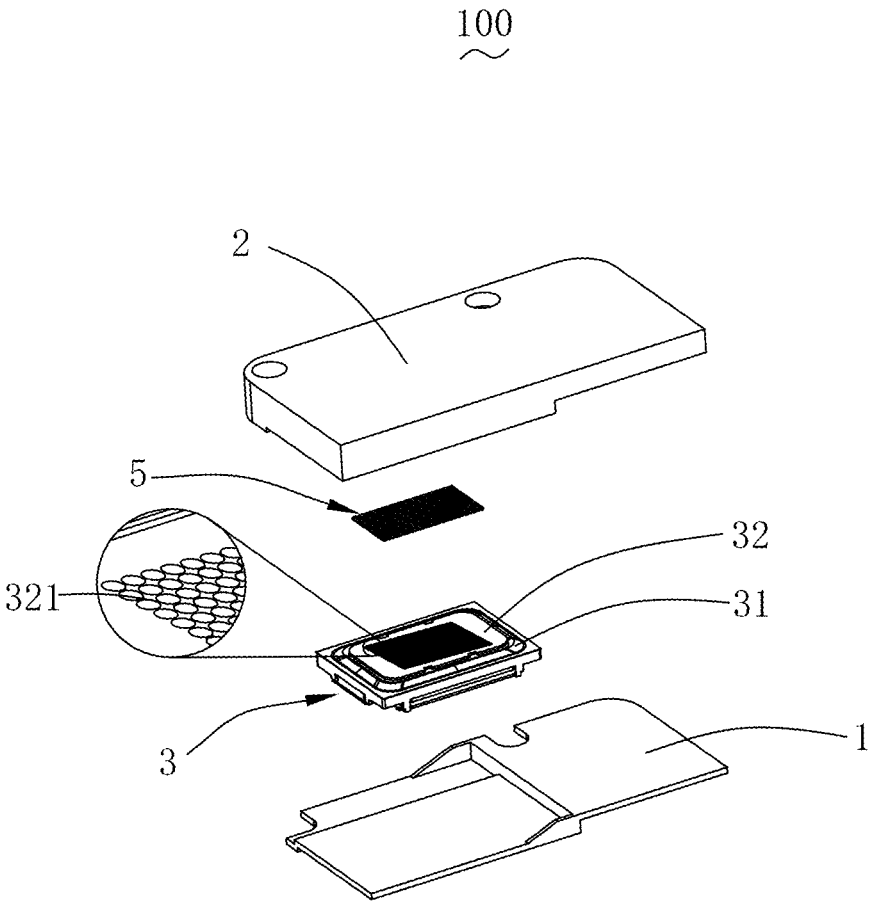
FIG. 2 is an exploded view of the speaker box in FIG. 1.
Figure 3:
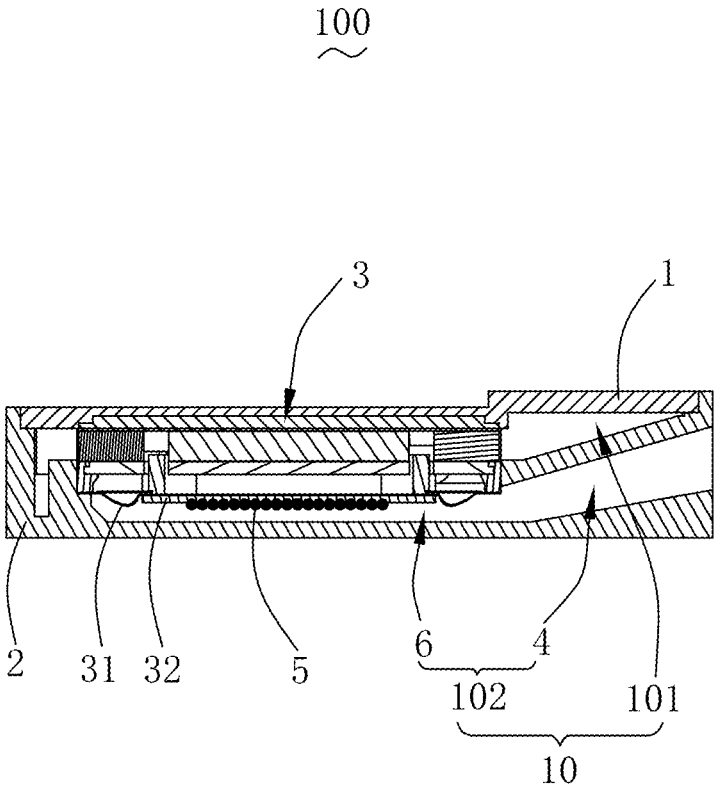
FIG. 3 is a cross-sectional view of the speaker box in FIG. 1, taken along line A-A.

Referring to FIGS. 1-3, a speaker box 100, in accordance with an exemplary embodiment of the present disclosure, includes a lower cover 1, an upper cover 2 engaging with the lower cover 1, a speaker 3, a sound passageway 4, and air adsorbent particles 5. The lower cover 1 and the upper cover

2 cooperatively form an accommodating space 10. The speaker 3 is accommodated in the accommodating space 10.

The speaker 3 includes a diaphragm 31 for radiating sounds and a dome 32 attached to the diaphragm 31. A front sound cavity 6 is formed between the diaphragm 31 and the upper cover 2, and a rear cavity 101 is formed between the diaphragm 31 and the lower cover 1. The sound passageway 4 is formed in the accommodating space 10, and specifically, the sound passageway 4 is formed in the upper cover 2. The sound passageway 4 communicates the front sound cavity 6 with the outside of the speaker box 100.

In this embodiment, the speaker 3 divides the accommodating space 100 into a front cavity 102 and the rear cavity 101. The front cavity 102 is formed by the sound passageway 4 and the front sound cavity 6. The rear cavity 101 is used for enhancing low-frequency performance.

The air adsorbent particles 5 are received in the front sound cavity 6 and positioned on the dome 32 of the speaker 3. When the dome 32 vibrates at high frequency, high frequency harmonic and noises are produced. Such harmonic and noises will be amplified resonantly. By virtue of the air adsorbent particles 5, the high frequency harmonic and noises will be adsorbed by the air adsorbent particles 5, which effectively improve the acoustic performance of the speaker box 100.

In the exemplary embodiment, the dome 32 forms a plurality of recesses 321 communicating with the front sound cavity 6 for receiving the air adsorbent particles 5 therein. The configuration of the recesses 321 enhances the stability of the engagement between the air adsorbent particles 5 and the dome 32. Further, the recesses 321 are capable of guiding and positioning the air adsorbent particles 5, so that the air adsorbent particles 5 can be effectively filled in the dome 32.

The air adsorbent particles 5 make the inner sides of the front sound cavity 6 rough, which increases the damping of the front sound cavity 6 and reduces distortion peaks of the speaker box 100. And accordingly, high-frequency noises and harmonic distortions are restrained. As a result, the acoustic performance of the speaker box 100 is improved.

The air adsorbent particles 5 can be positioned in the recesses 321 by adhesive. Or, the air adsorbent particles 5 can be sealed in the recesses 321 by a mesh.

It should be noted that the air adsorbent particles 5 can also be positioned in the sound passageway 4. The recesses 321 may be configured to be an array, and the air adsorbent particles 5 are disposed in the array of recesses. The air adsorbent particles 5 are nanoscale porous particle polymerizations. Preferably, the diameter of the air adsorbent particle is less than 100 um.

Figure 4:
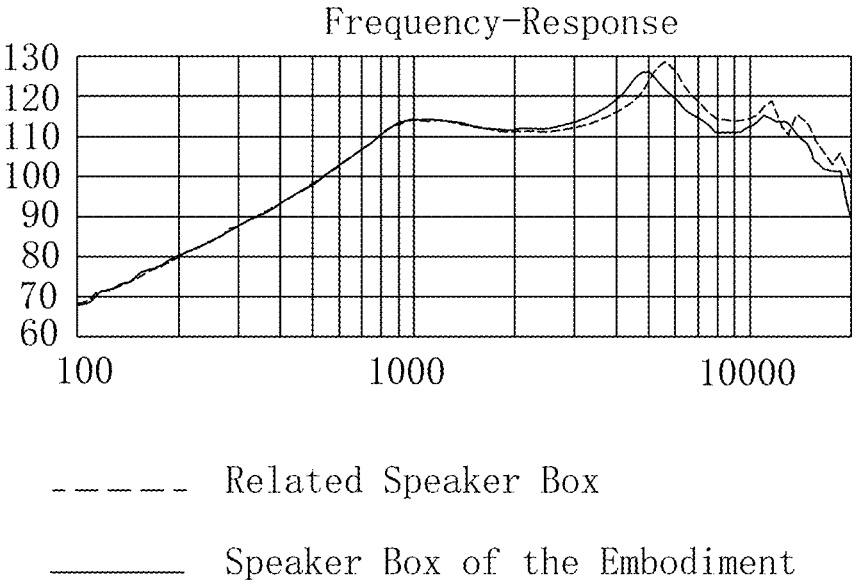
FIG. 4 shows frequency-response curves of the speaker box of the exemplary embodiment and the related speaker box.

Referring to FIG. 4, frequency-response curves of the speaker box of the invention and related speaker box are shown. It can be seen that resonance peaks of the front cavity 102 are obviously reduced.

Figure 5:
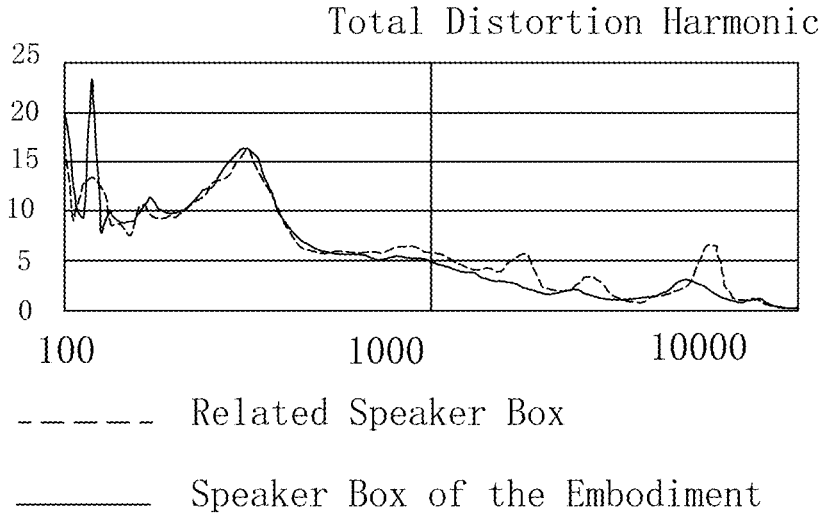
FIG. 5 shows total harmonic distortion curves of the speaker box of the invention and the related speaker box.

Referring to FIG. 5, the distortion peaks of the front cavity 102 are effectively reduced.

Compared with related technologies, the air adsorbent particles 5 make the inner sides of the front sound cavity 6 rough, which increases the damping of the front sound cavity 6 and reduces distortion peaks of the speaker box 100. And accordingly, high-frequency noises and harmonic distortions are restrained. As a result, the acoustic performance of the speaker box 100 is improved.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A speaker box, comprising:

a lower cover;

an upper cover engaging with the lower cover for forming an accommodating space;

a speaker accommodated in the accommodating space, and including a diaphragm with a dome attached to the diaphragm;

a front sound cavity formed by the diaphragm and the upper cover;

air adsorbent particles received in the front sound cavity for absorbing the high frequency harmonic and noises; wherein the dome forms at least one recess communicating with the front sound cavity, and the air adsorbent particles are received in the recesses.

2. The speaker box as described in claim 1, wherein the air adsorbent particles are nanoscale porous particles.

3. The speaker box as described in claim 2, wherein a diameter of the air adsorbent particle is less than 100 um.

4. The speaker box as described in claim 1, wherein the air adsorbent particles are positioned in the recess by adhesive.

5. The speaker box as described in claim 1, wherein the air adsorbent particles are sealed in the recess by a mesh.

6. The speaker box as described in claim 1, wherein the recesses are configured to be an array, and the air adsorbent particles are received in the array of recesses.

7. The speaker box as described in claim 1 further including a sound passageway communicating the front sound cavity with outside, and the passageway forms a front cavity together with the front sound cavity.

* * * * *